United States Patent [19]

Sandor

[11] Patent Number: 4,850,658

[45] Date of Patent: Jul. 25, 1989

[54] JEWELRY STORAGE CONTAINER

[76] Inventor: Joyce Sandor, 208-90 Chandos Avenue, Winnipeg, Manitoba, Canada, R2H 1Y2

[21] Appl. No.: 213,353

[22] Filed: Jun. 30, 1988

[51] Int. Cl.[4] ..... A47G 1/00

[52] U.S. Cl. ..... 312/225; 312/125; 312/252; 211/13; 211/163

[58] Field of Search ..... 312/135, 225, 252, 285, 312/300, 305, 224, 125; 211/13, 129, 131, 163, 189; 206/45.15, 495, 566

[56] References Cited

U.S. PATENT DOCUMENTS

| | | | |
|---|---|---|---|
| 847,342 | 1/1906 | Hodny | 312/227 |
| 943,454 | 12/1909 | Pecoy | 211/131 |
| 1,134,908 | 4/1915 | Romsos | 312/135 |
| 1,393,050 | 10/1921 | Talley et al. | 312/135 |
| 1,416,566 | 5/1922 | McCleary | 312/305 |
| 1,611,179 | 2/1926 | Fisher | 312/125 |
| 1,630,469 | 11/1926 | Cecil | 312/125 |
| 1,948,738 | 5/1931 | Thayer | 312/234 |
| 2,418,225 | 11/1944 | Gross et al. | 312/119 |
| 2,512,465 | 6/1950 | Moorhouse | 312/125 |
| 2,972,420 | 2/1961 | Tucci | 211/95 |
| 3,109,685 | 3/1962 | Skorupa | 312/204 |
| 3,880,484 | 4/1975 | Sicina | 312/125 |
| 3,997,219 | 12/1976 | Phelps | 312/234 |
| 4,058,356 | 11/1977 | Michal | 312/305 |
| 4,093,077 | 6/1978 | Strasser | 211/13 |
| 4,116,508 | 9/1978 | Sturtevant | 312/245 |
| 4,267,998 | 5/1981 | Weirich | 248/174 |
| 4,324,446 | 4/1982 | LeSage | 312/245 |
| 4,442,942 | 4/1984 | Cuminale | 211/163 |
| 4,463,856 | 8/1984 | Strasser | 312/125 |
| 4,632,474 | 12/1986 | Ingersoll | 312/135 |

FOREIGN PATENT DOCUMENTS

| | | | |
|---|---|---|---|
| 1150683 | 4/1969 | United Kingdom | 211/131 |

*Primary Examiner*—Peter R. Brown
*Assistant Examiner*—Brian K. Green
*Attorney, Agent, or Firm*—Adrian D. Battison; Stanley G. Ade; Murray E. Thrift

[57] ABSTRACT

A jewelry support device comprises an upper section defined by an upper octagonal plate and a lower octagonal plate between which are supported four jewelry support members each formed by two plates at right angles rotatable relative to the plates about a vertical axis at a mid-line of the plates. The members are spaced around the periphery of the plates with mirrored panels positioned between each member and the next to provide a pleasing appearance. A lower section of the device is formed by drawers between the lower plate and a bottom plate with the drawers being pie-shaped. A base plate can be supported on a suitable surface with the whole device being rotatable relative to the base plate by a suitable bearing. The device allows organized storage of a large quantity of jewelry particularly earrings and ready access to the jewelry in a device of attractive appearance.

16 Claims, 3 Drawing Sheets

JEWELRY STORAGE CONTAINER

BACKGROUND OF THE INVENTION

This invention relates to a jewelry storage device which is primarily intended for use in the home as an attractive storage device for jewelry of different types including particularly earrings, necklaces, bracelets and rings which allows the jewelry to be effectively organized and readily accessible.

Many ladies collect jewelry as an attractive accessory and can obtain very large amounts of such jewelry particularly the less expensive costume type jewelry including rings, earrings, necklaces and the like which can be tailored and selected for particular outfits and particular colors. The conventional jewelry box even with separate compartments is hardly satisfactory for storage of large collections of jewelry of this type since the items are is most cases merely placed within a compartment and hence are not accessible to view and can become tangled and disarrayed.

Various designs of jewelry boxes have previously been proposed for example U.S. Pats. Nos. 4,058,356 (Michal), 3,880,484 (Sicina), 4,324,446 (Lesage) and 3,997,219 (Phelps). However none of these devices are satisfactory in that the storage of earrings, rings and the like is very limited and the device in most cases does not provide the desirable display effect of individual earrings, necklaces, bracelets and rings for easy access and total organization.

Various other types of storage device are shown in U.S. Pats. Nos. 1,611,179 (Fisher), 1,630,469 (Cecil), 2,418,225 (Gross), 4,442,942 (Cuminale), 1,948,738 (Thayer), 4,116,508 (Sturtevant), 3,109,685 (Skorupa) and 847,342 (Hodny). None of these devices is again satisfactory for the storage of individual earrings in large numbers together with other pieces of jewelry.

Devices have also been proposed of various types for displaying merchandise for sale in a retail environment and the above patents to Cecil and Cuminale show devices suitable for this end use. However they are not suitable for use in the home for proper storage of individual earrings in large quantities of various types of jewelry.

SUMMARY OF THE INVENTION

It is one object of the present invention, therefore, to provide an improved arrangement for storage of jewelry and particularly individual earrings in an attractive and useful arrangement.

According to a first aspect of the invention therefore there is provided a jewelry storage device comprising a support structure having a base member for resting upon a support surface, an upper part of the support structure being rotatable relative to the base member about a vertical main axis so as to allow access by a user to the full periphery of the support structure, the support structure carrying a plurality of jewelry receiving members mounted on said support structure at angularly spaced positions around the periphery thereof, each said jewelry receiving member being individually rotatable relative to the support structure about an axis parallel to said main axis.

According to a second aspect of the invention there is provided a jewelry storage device arranged for use with individual earrings of the type comprising an earring body having a stud and a backer slidable on the stud and with earrings of the type comprising an earring body and a wire hooks the device comprising a support structure including a base member for resting on a support surface and a plurality of jewelry support members each said jewelry receiving member comprising a plurality of panel members mounted on the support structure so that rotation of said jewelry receiving members allows access by a user to chosen ones of said panel members at least one of said panel members comprising a substantially rigid sheet having a plurality of holes therein dimensioned to receive a stud of an earring with the backer attached to the stud on a side of the sheet opposite to the body of the earrings, and at least one of the panel members comprising a plurality of elongate horizontal rung members arranged in vertically spaced relation and dimensioned such that each can receive at least one wire hook of an earring with the body of the earring suspended therefrom.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
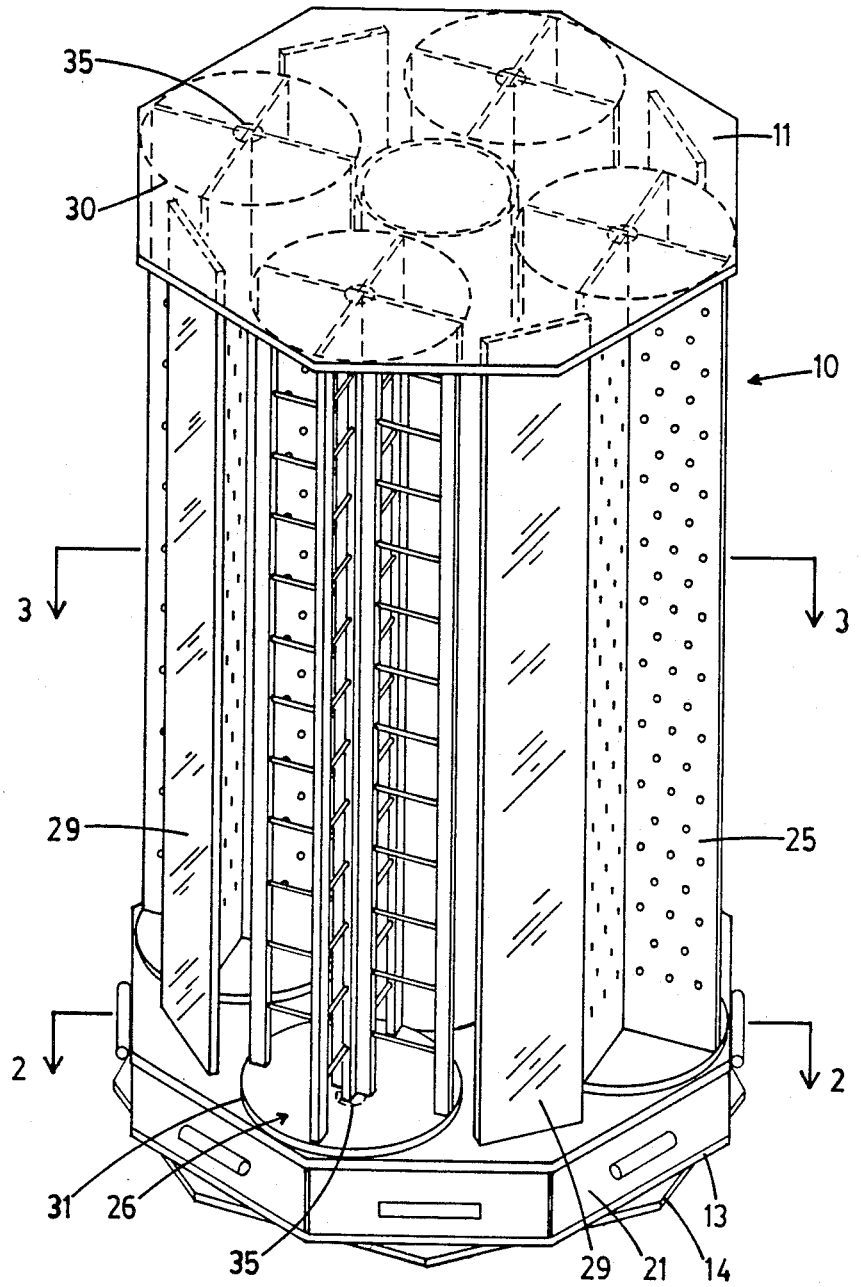
FIG. 1 is an isometric view from one side of a jewelry storage device according to the invention.
Figure 3:
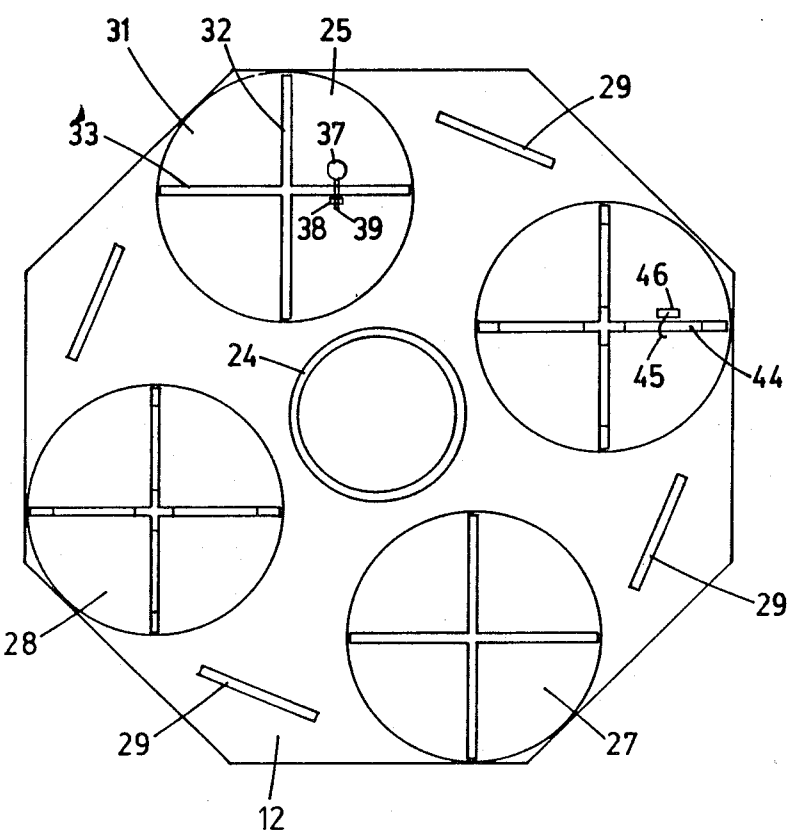
FIG. 3 is a cross sectional view in a horizontal plane taken along the line 3—3 of FIG. 1.

The jewelry support device shown in the drawings is generally indicated at 10 and is formed from four flat plates 11, 12, 13 and 14 all of which are of regular octagonal shape and of the same dimensions. The lowermost plate 14 forms a base plate having an undersurface for resting upon a suitable support. The bottom plate 13 lies substantially directly on top of the base plate 14 with a flat bearing arrangement 15 positioned between the two plates so as to allow rotation of the bottom plate 13 relative to the base plate 14 about a vertical central axis. The bearing is not shown in detail as this will be within the skill of one in the art. The base plate 14 is shown offset from the bottom plate 13 to indicate the possibility of rotation of one relative to the other.

Figure 2:
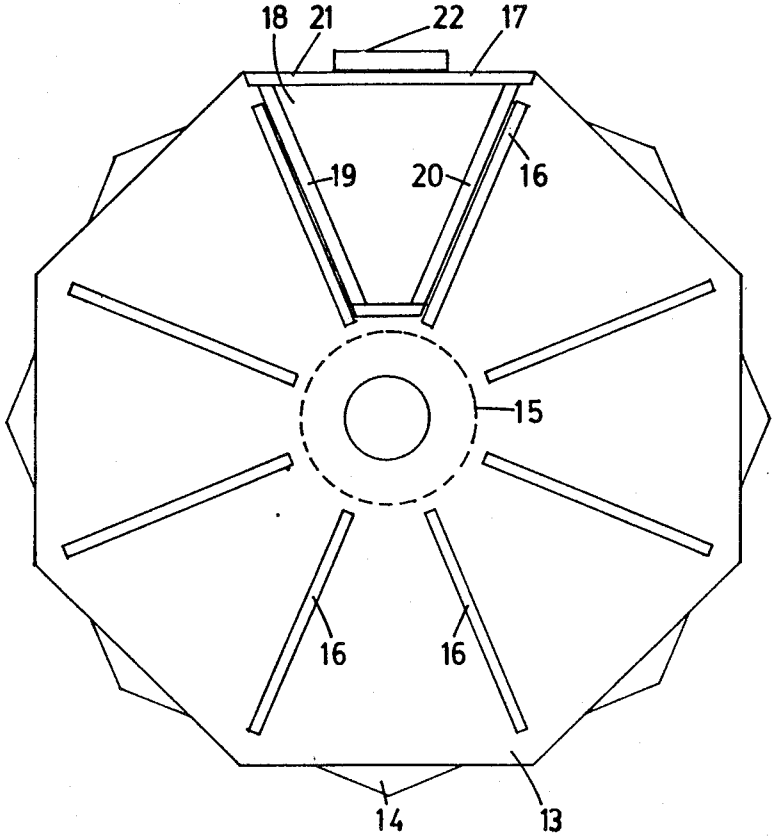
FIG. 2 is a cross sectional view on the horizontal plane taken along the lines 2—2 of FIG. 1.

The plate 12 is supported relative to the bottom plate 13 at a spaced position therefrom by a plurality of upstanding dividers 16 shown in FIG. 2. The dividers 16 extend radially from the imaginary central axis and are directed toward an apex of the octagonal shape but terminate at a position spaced a short distance therefrom. Thus the plate 12 and the plate 13 together with the dividers 16 form a plurality of wedge shaped areas of rectangular elevation. Into each of the wedge shaped areas is inserted a drawer 17 having a base plate 18, converging sides 19 and 20 and an outer face panel 21 carrying a suitable handle 22. The face panels 21 of all of the drawers are arranged to cooperate with the rectangular area defined at the outer edge of the panels 12 and 13 so that when all of the drawers are closed as shown in FIG. 1, the face panels fully cover the area between the panels 12 and 13. The drawers can however be withdrawn in a radial direction to allow access to the interior of the drawer. When closed the tapered side walls 19 and 20 cooperate with the divider 16 to locate the drawer in the required position placing the face plate 21 in the plane of the edges of the plates 12 and 13.

The upper plate 11 is spaced from the lower plate 12 by a distance significantly greater than the lower part of the device with the spacing being defined by a central cylindrical column 24.

Four jewelry support members are mounted in the area between the upper and lower plates 11 and 12 and are indicated respectively at 25, 26, 27 and 28. The jewelry support members 25 through 28 are spaced angularly around the central axis of the device are equidistantly spaced so that a center of each jewelry support member lies on a radius of the central axis intersecting one of the apexes of the octagonal shape. Thus the four jewelry support members are arranged at alternate ones of the apexes of the octagonal shape.

In between each jewelry support member and the next is arranged a panel of mirrored material indicated at 29. The panel 29 has a height equal to the spacing between the upper and lower plates 11 and 12 and a width such that it fills the majority of the space between the adjacent jewelry support members while lying on or approximately on a line which is tangential to both of the jewelry support members. Thus the mirrored panels 29 define with outer parts of the support members an outer face of the device. The device thus presents an attractive outer appearance provided by part of the jewelry which is visible on the jewelry support members and provided by the mirrored surface of the panels 29.

Each of the jewelry support members if formed of an upper disc 30 and a lower disc 31 of circular plan. Attached to the upper side of the lower disc and to the under side of the upper disc is a pair of panel members 32 and 33 which intersect at right angles with both of the panels being attached to the disc so that they are held in position to form right angle faces for supporting jewelry. In order to provide the interconnection, each of the panels has a slot 34 equal to half the height of the panel. One panel can be einverted, turned at right angles and inserted onto the other with the slots cooperating to unite the two panels at right angles. The height of the united panels is equal to the spacing between the two discs 30 and 31. Each of the discs is mounted upon a suitable bearing member 35 so the whole of the jewelry support member can rotate about an axis which is vertical, parallel to the central main axis with the axes spaced equidistantly around the main axis. Thus each individual jewelry support member which is presented at the area between two of the panels 29 can be rotated by the user pushing against one of the panels so as to expose the jewelry hanging in the 90° area between two of the panels.

Figure 4:
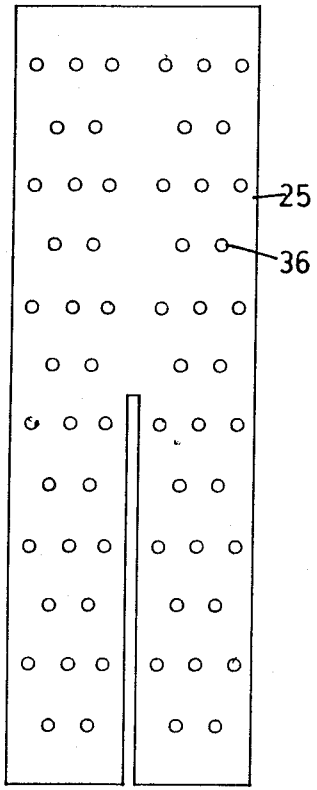
FIG. 4 is an elevational view of one of the panels forming the jewelry supporting members of FIG. 1.

As shown best in FIG. 4, the panels forming the jewelry support member 25 are formed from thin transparent acrylic sheet which has sufficient rigidity to provide a rigid support. The acrylic sheet has a plurality of holes 36 drilled through the sheet so the sheet can support an earring indicated at 37 having a stud 38 passing through one of the holes 36 so that the backer 39 attaches to the stud to hold the earring body in place on the sheet. Both panels are formed in this structure so as to define a rotatable unit which can support a large number of earrings of the stud type.

Figure 5:
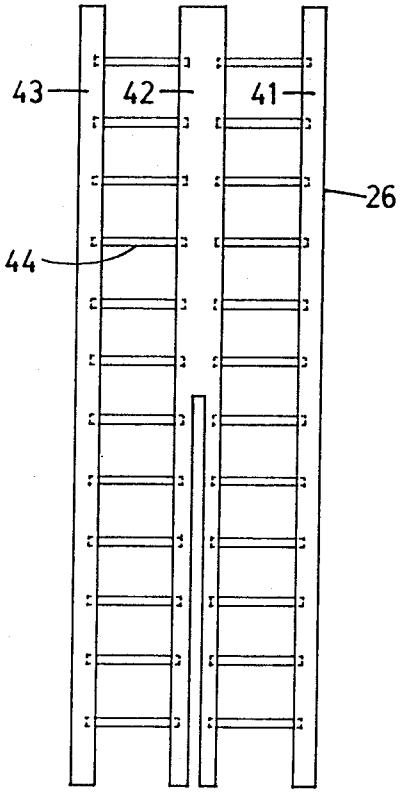
FIG. 5 is an elevational view of a second panel forming a jewelry supporting member of FIG. 1.

As shown in FIG. 5, the jewelry support member 26 is formed from two panels each of which includes three vertical support struts 41, 42 and 43 which are formed from a sheet of a transparent acrylic material together with a plurality of transverse rungs 44 which are horizontal and elongate and arranged in parallel spaced relation along the length of the support struts. Each rung 44 thus forms a support for one or more wire hooks one of which is shown at 45 of an earring body 46.

Figure 6:
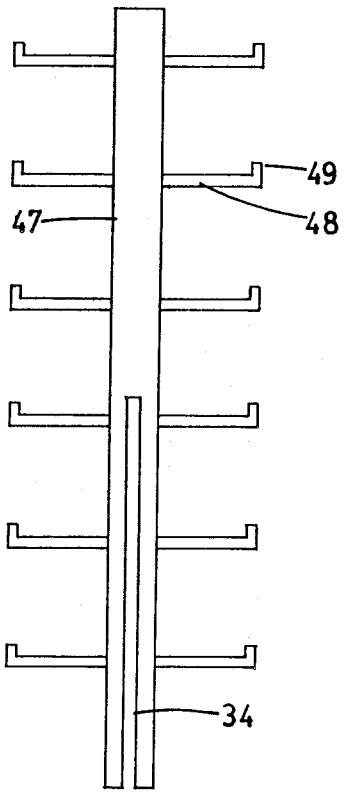
FIG. 6 is an elevational view of a third panel forming a jewelry supporting member of FIG. 1.

As shown in FIG. 6 a further one of the jewelry support members 27 and 28 is formed from panel members in which there is a central support strut 47 to which is attached a plurality of arms 48 which extend outwardly in a plane of the panel and include an upward hook portion 49 to enable for example rings or other similar jewelry to be supported.

The plates 11, 12, 13 and 14 together with at least the facing panels of the drawers are preferably formed of a dark acrylic sheet material which is partially transparent to provide a pleasing appearance.

Since various modifications can be made in my invention as hereinabove described, and many apparently widely different embodiments of the invention made within the spirit and scope of the claims without departing from such spirit and scope, it is intended that all matter contained in the accompanying specification shall be interpreted as illustrative only and not in a limiting sense.

I claim:

1. A jewelry storage device comprising a support structure having a base member for resting upon a support surface, an upper part of the support structure including a horizontal top plate and a horizontal bottom plate being rotatable relative to the base member about a vertical main axis so as to allow access by a user to the full periphery of the support structure, a plurality of jewelry receiving members mounted on said support structure between said top plate and said bottom plate at angularly spaced positions around the periphery thereof, each said jewelry receiving member being individually rotatable relative to the support structure about a respective axis parallel to said main axis each member comprising a plurality of flat vertical panels joined at said respective axis, outer edges of the panels lying substantially in an imaginary cylinder surrounding the respective axis, and a plurality of mirrored panels fixedly mounted so as to extend between said top plate and said bottom plate each mirrored panel being located between two of said jewelry receiving members and spaced outwardly of a line joining the respective axis of two of said jewelry receiving members adjacent the periphery of the top and bottom plates.

2. The invention according to claim 1 wherein each jewelry receiving member comprises a pair of flat panels arranged mutually at right angles and intersecting along a mid-line thereof to form a cross-shape in horizontal cross section.

3. The invention according to claim 2 including upper and lower disc members connected to said panels at upper and lower edges thereof.

4. The invention according to claim 1 wherein the mirrored panels are arranged to lie substantially on a line tangential to the outer periphery of said two of said jewelry receiving members.

5. The invention according to claim 1 wherein the support structure comprises a lower plate upon which said jewelry receiving members are mounted and a bottom plate parallel to the lower plate and spaced therefrom beneath the lower plate so as to define an area therebetween, and a plurality of drawers mounted in said area with each drawer being movable in a direction radially of the main axis from a closed position fully within the area to an open position outwardly of the area.

6. The invention according to claim 5 wherein each of the drawers has sides converging inwardly toward the main axis.

7. The invention according to claim 1 arranged for use with earrings of the type comprising an earring body, a stud and a backer slidably receivable on the stud wherein at least one of said panels comprises a substantially rigid sheet having a plurality of holes therein dimensioned to receive the stud of an earring with the backer attached to the stud on a side of the sheet opposite to the body of the earring.

8. The invention according to claim 1 arranged for use with the earrings of the type comprising an earring body and wire hook, wherein at least one of the panels comprises a plurality of elongate horizontal rung members supported in vertically spaced relation and dimensioned such that each can receive at least one wire hook of an earring with the body of the earring suspended therefrom.

9. The invention according to claim 8 wherein the panel comprises a pair of vertical side bars with the rung members connected there across in parallel spaced relation.

10. The invention according to claim 1 wherein at least one of the panels comprises a plurality of hooks lying in a plane of the panel and extending outwardly from a vertical central support member.

11. The invention according to claim 1 wherein the panels are arranged in pairs connected mutually at right angles along mid-lines of each pair so as to form a cross-shape in horizontal cross section.

12. The invention according to claim 11 wherein each of the panels includes a slot along the mid-line so as to cooperate with a slot of the other panel of the pair so that the panels can be formed in cross shape by sliding together in a longitudinal direction and wherein there is provided a disc member at the upper and lower edges of each of the panels.

13. A jewelry storage device arranged for use with individual earrings of the type comprising an earring body, a stud and a backer slidable on the stud and with earrings of the type comprising a wire hook suspending an earring body, the device comprising a support structure including a base member for resting on a receiving surface and a plurality of jewelry support members each said jewelry receiving member comprising a plurality of flat vertical panels joined at a central axis and mounted on the support structure so that rotation of said jewelry receiving member about said central axis allows access by a user to chosen ones of said panels, at least one of said panels comprising a substantially rigid sheet having a plurality of holes therein dimensioned to receive a stud of an earring with the backer attached to the stud on a side of the sheet opposite to the body of the earring and at least one of the panels comprising a pair of vertical side bars and a plurality of elongate horizontal rung members connected between the side bars in vertically spaced relation and dimensioned such that each can receive at least one wire hook of an earring with the body of the earring suspended therefrom.

14. The invention according to claim 13 wherein at least one of the panels comprises a plurality of hooks lying in a plane of the panel and extending outwardly from a vertical central support member.

15. The invention according to claim 13 wherein the panel members are arranged in pairs connected mutually at right angles along mid-lines of each pair so as to form a cross-shape in horizontal cross section.

16. The invention according to claim 15 wherein each of the panels includes a slot along the mid-line so as to cooperate with a slot of the other panel of the pair so that the panels can be formed in cross shape by sliding together in a longitudinal direction and wherein there is provided a disc member at the upper and lower edges of each of the panels.

* * * * *